US008342513B2

(12) United States Patent
Yamaguchi

(10) Patent No.: US 8,342,513 B2
(45) Date of Patent: Jan. 1, 2013

(54) SHEET STORAGE DEVICE

(75) Inventor: Yoshihiro Yamaguchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 13/328,854

(22) Filed: Dec. 16, 2011

(65) Prior Publication Data

US 2012/0205861 A1 Aug. 16, 2012

(30) Foreign Application Priority Data

Feb. 10, 2011 (JP) ..... 2011-026673

(51) Int. Cl.
*B65H 1/08* (2006.01)
*B65H 1/12* (2006.01)

(52) U.S. Cl. ..... 271/160; 271/162; 271/126

(58) Field of Classification Search ..... 271/147, 271/160, 162, 145, 126
See application file for complete search history.

(56) References Cited

U.S. PATENT DOCUMENTS 7,686,293 B2 * 3/2010 Baena et al. ..... 271/147
7,766,320 B2 * 8/2010 Baena et al. ..... 271/147
8,041,285 B2 * 10/2011 Hashimoto et al. ..... 399/379
2010/0038845 A1 * 2/2010 Baena et al. ..... 271/160
2010/0038846 A1 * 2/2010 Baena et al. ..... 271/162

FOREIGN PATENT DOCUMENTS

JP 05-162860 6/1993
JP 05-270668 10/1993
JP 2003-020129 1/2003

* cited by examiner

*Primary Examiner* — Patrick Cicchino

(74) *Attorney, Agent, or Firm* — Smith, Gambrell & Russell, LLP

(57) ABSTRACT

When a sheet cassette (10*a*) is pulled out of the body of an image forming apparatus (100), winding pulleys (40*a* and 40*b*) are rotated by the weight of a lift plate. An idle gear (47) also is rotated by a predetermined amount, so that the engagement portion (47*b*) thereof engages with a second arm portion (50*c*) of a torsion spring (50). Since a force exerted by the torsion spring (50) is set greater than the force that rotates the idle gear (47) by downward movement of lift plate (30), rotation of the idle gear (47) and winding pulley (40*a*) is regulated, and thus the upper surface of lift plate (30) stops in a substantially constant position with respect to sheet supply opening portions (31*a* and 31*b*).

6 Claims, 4 Drawing Sheets

SHEET STORAGE DEVICE

This application is based on and claims the benefit of priority from Japanese Patent Application No. 2011-26673 filed on Feb. 10, 2011, the contents of which are hereby incorporated by reference.

BACKGROUND OF THE DISCLOSURE

1. Field of the Disclosure

The present disclosure relates to a large-capacity sheet storage device that stores sheets and that feeds sheets to an image forming apparatus such as a copying machine, a printer or a facsimile. More particularly, the present disclosure relates to a method of enhancing the performance of setting sheets in sheet stacking means.

2. Description of Related Art

For example, when a large number of users share one image forming apparatus, the number of sheets that are used per image forming apparatus is increased. Hence, a large-capacity sheet storage device that further increases the number of sheets which can be stored therein is being developed.

For example, there is known a large-capacity paper feed device in which a tray that stacks sheets within a tray unit is supported by an elastic support member (coil spring) and thus the tray is prevented from rapidly dropping when the tray is separated from a drive portion. Moreover, there is known a sheet feed device in which, when the door of a sheet storage unit is opened, a force that acts to raise sheet stacking means is released and thus the sheet stacking means is rapidly lowered to the bottom of the sheet storage unit without use of power of a motor or the like.

Furthermore, there is known a copying machine incorporating a large-capacity sheet tray in which a brake dumper having a cam and a brake plate provided at one end of a wire winding shaft is included, thus the downward speed of a sheet stage is maintained regardless of the remaining number of sheets, a sheet stage downward movement waiting time is reduced and safety is enhanced.

Since, in the large-capacity sheet storage device as described above, a thousand or more sheets are supplied, when the sheets are supplied, a user supplies those sheets into a sheet storage cassette (sheet storage portion) by performing a plurality of rounds of sheet supply.

However, since, in the configuration described above, the sheet stacking means such as the tray and the sheet stage is lowered either to the lowermost part of the sheet storage portion or to the vicinity of the lowermost part, when sheets are set, the side wall of the sheet storage portion may become an obstacle. Consequently, there is possibility that the workability is reduced, and that a sheet setting failure occurs and therefore a paper feed failure occurs.

Even in the method of supporting with the elastic support member the tray for stacking sheets, it is possible to maintain the position to which the tray is lowered. However, since, when the tray is separated from the drive portion, the drawing out of a wire is not performed in synchronization with the lowering of the tray, the wire loosens, with the result that, when the wire significantly loosens, the wire may be separated from a pulley.

SUMMARY OF THE DISCLOSURE

In view of the foregoing problem, the present disclosure has an object to provide a sheet storage device in which a simple configuration is used to constantly place sheet stacking means on standby in a given position and thus the performance of setting sheets is enhanced.

To achieve the above object, according to one aspect of the present disclosure, a sheet storage device according to one aspect of the present disclosure includes a sheet storage portion that stores a sheet, a sheet supply opening portion that is formed from an upper end of a side wall of the sheet storage portion in a vertically downward direction, a lift plate that is arranged in the sheet storage portion such that the lift plate can be moved up and down, a wire with which the lift plate is hung, and a winding pulley that moves the lift plate up to a predetermined position by winding the wire. The sheet storage device where, with the sheet storage device removed from a body of an image forming device, the winding pulley is reversely rotated by a weight of the lift plate and the lift plate is lowered includes an idle gear that engages with a gear portion formed in the winding pulley, and a torsion spring that has a winding spring portion which is fitted to a rotation shaft of the idle gear and a first arm portion and a second arm portion which extend from the winding spring portion. Here, the first arm portion is fixed to the side of the sheet storage portion and an engagement portion engaging with the second arm portion is provided on the side surface of the idle gear such that an upper surface of the lift plate on which no sheet is stacked is stopped in a substantially constant position equal to or higher than a lower end portion of the sheet supply opening portion.

Other and further objects of the present disclosure and specific advantages achieved by the present disclosure will be further obvious from the following description of an embodiment.

DETAILED DESCRIPTION OF PREFERRED EMBODIMENTS

Figure 1:
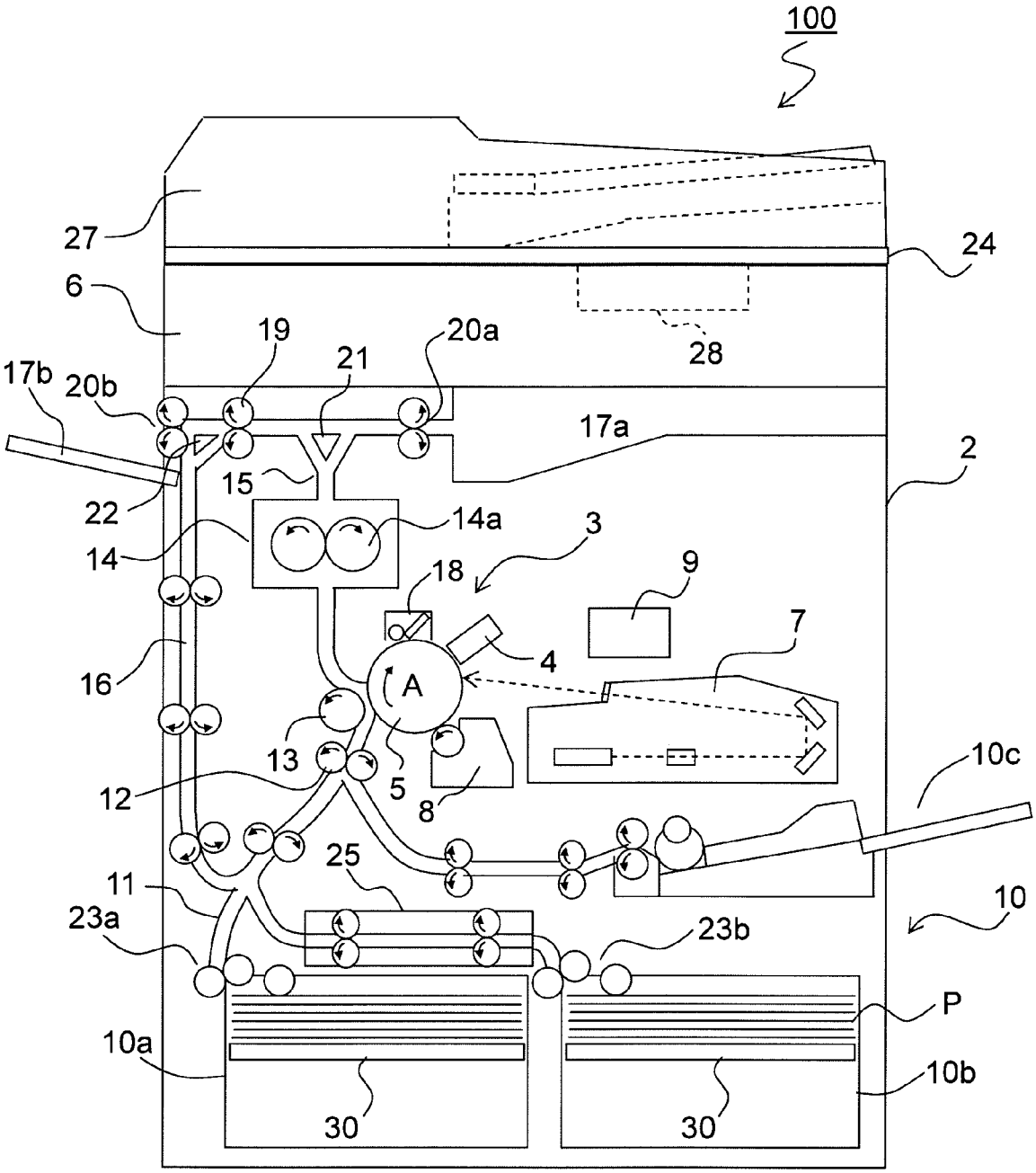
FIG. 1 is a schematic diagram showing the configuration of an image forming apparatus 100 incorporating a sheet storage device of the present disclosure.

An embodiment of the present disclosure will be described below with reference to accompanying drawings. FIG. 1 is a schematic diagram showing the configuration of an image forming apparatus incorporating a sheet storage device according to the embodiment of the present disclosure. In FIG. 1, when the image forming apparatus 100 (here, a digital multifunction machine is shown as an example) performs a copying operation, an image reading portion 6, which will be described later, reads image data on an original document and converts it into an image signal. On the other hand, an image formation portion 3 within the multifunction machine body 2 evenly charges, with a charge unit 4, a photoconductive drum 5 that is rotated in a direction indicated by A in the figure. By a laser beam from an exposure unit (a laser scanning unit and the like) 7 based on the original document image data read by the image reading portion 6, an electrostatic latent image is formed on the photoconductive drum 5. Furthermore, a developing unit 8 attaches a developing agent (hereinafter referred to as toner) to the electrostatic latent image to form a toner image. The supply of the toner to the developing unit 8 is performed from a toner container 9.

Toward the photoconductive drum 5 on which the toner image has been formed as described above, a sheet is transported from a paper supply mechanism 10 to the image formation portion 3 through a sheet transport path 11 and a registration roller pair 12. In the image formation portion 3, the toner image on the surface of the photoconductive drum 5 is transferred by a transfer roller 13 (image transfer portion) to the sheet. The sheet to which the toner image has been transferred is separated from the photoconductive drum 5, and is transported to a fixing portion 14 having a fixing roller pair 14*a* where the toner image is fixed. The sheet that has passed through the fixing portion 14 is send to a sheet transport path 15 that branches in a plurality of directions; by path switching mechanisms 21 and 22 having a plurality of path switching guides provided in the branch point of the sheet transport path 15, the direction of transportation of the sheet is allocated. The allocated sheet is ejected, as it is (or after it is sent to a reverse transport path 16 and double-sided copying is performed on it), into a sheet ejection portion formed with a first ejection tray 17*a* and a second ejection tray 17*b*.

Although not shown in the figure, a charge elimination device for eliminating charge left on the surface of the photoconductive drum 5 is provided on the downstream side of a cleaning device 18. The paper supply mechanism 10 includes: two sheet cassettes 10*a* and 10*b* that are removably attached to the multifunction machine body 2 and that store sheets; and a stack bypass (manual tray) 10*c* that are provided thereabove. The sheet cassettes 10*a* and 10*b* and the stack bypass 10*c* are connected through the sheet transport path 11 to the image formation portion 3 composed of the photoconductive drum 5, the developing unit 8 and the like.

In each of the sheet cassettes 10*a* and 10*b*, a lift plate 30 is provided that can reciprocate vertically; sheets P that are placed on the lift plate 30 are pressed, by the lift plate 30, onto a pickup roller that constitutes paper feed mechanisms 23*a* and 23*b*, and are fed to the sheet transport path 11. The sheets P in the sheet cassette 10*b* are fed to the sheet transport path 11 through a horizontal transport unit 25. The detailed configuration of the sheet cassettes 10*a* and 10*b* will be described later, Above the device body, the image reading portion 6 is arranged; on the upper surface of the device body, a platen (an original document holder) 24 which holds and retains the original document placed on the contact glass (unillustrated) of the image reading portion 6 is formed such that the platen can be opened and closed. On the platen 24, an original document transport device 27 is provided. On the front surface of the image reading portion 6, an operation panel 28 is arranged.

Specifically, the sheet transport path 15 first branches into two paths, that is, leftward and rightward paths on the downstream side of the fixing roller pair 14*a*; one of the paths (in FIG. 1, the path that branches in the rightward direction) is configured to communicate with the first ejection tray 17*a*. On the other hand, the other path (in FIG. 1, the path that branches in the leftward direction) passes through a transport roller pair 19 and branches into two paths; one of the paths (in FIG. 1, the path that branches in the leftward direction) is configured to communicate with the second ejection tray 17*b*. On the other hand, the other path (in FIG. 1, the path that branches in the downward direction) is configured to communicate with the reverse transport path 16.

Figure 2:
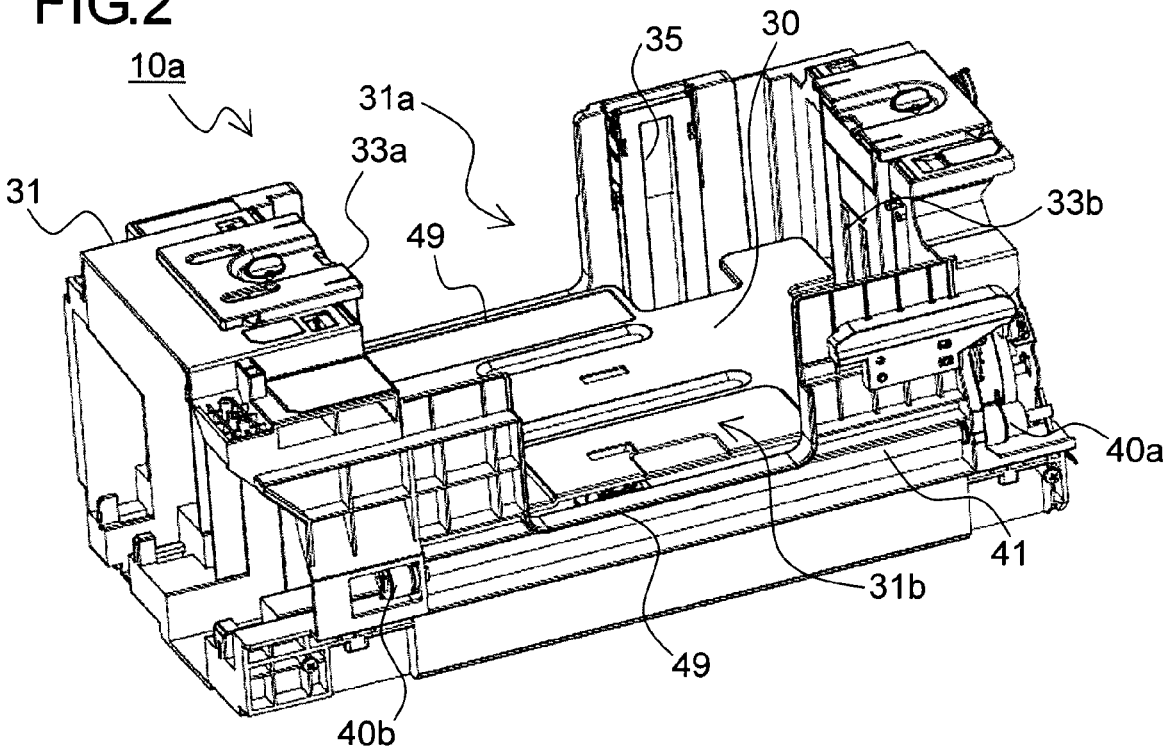
FIG. 2 is an appearance perspective view of a sheet cassette 10*a* that is the sheet storage device according to an embodiment of the present disclosure.
Figure 3:
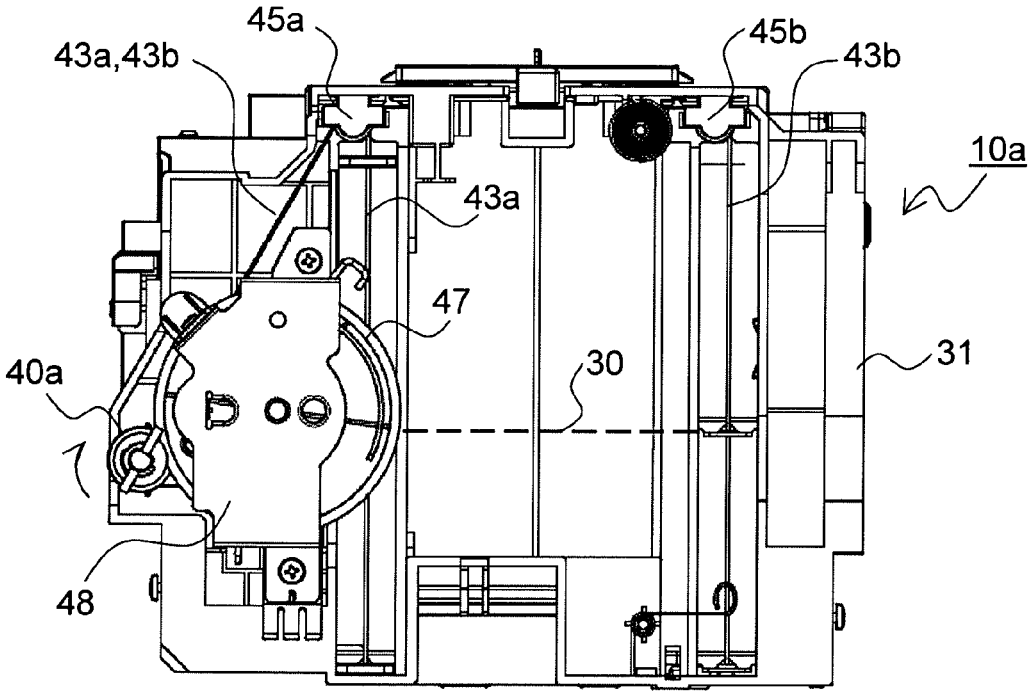
FIG. 3 is a side view when the sheet cassette 10*a* is seen from a rightward direction of FIG. 2.

FIG. 2 is an appearance perspective view of the sheet cassette 10*a* incorporated in the image forming device of FIG. 1; FIG. 3 is a side view when the sheet cassette 10*a* is seen from a rightward direction of FIG. 2. The sheet cassette 10*a* is of a large-capacity type that can store a thousand or more sheets; sheets are supplied from an upper portion of a sheet storage portion 31. In the sheet storage portion 31, the lift plate 30 that can be vertically moved up and down is arranged. Although the configuration of the sheet cassette 10*a* will be described below, the same is true of the sheet cassette 10*b*.

In the sheet storage portion 31, a pair of width regulation members 33*a* and 33*b* that locates the sheets in the sheet width direction and a back end regulation member 35 that aligns the back ends of the sheets are provided such that they stand. The width regulation members 33*a* and 33*b* and the back end regulation member 35 are arranged in predetermined positions, and thus the sheets of a predetermined size can be stored in a predetermined position within the sheet storage portion 31. In the wall portions on the upstream side (the back side of FIG. 2) of and on the downstream side (the front side of FIG. 2) of the sheet storage portion 31 in the paper feed direction, sheet supply opening portions 31*a* and 31*b* are formed; when sheets are supplied from the upper portion of the sheet storage portion 31, hands are inserted through the sheet supply opening portions 31*a* and 31*b* to place the sheets on the lift plate 30.

In a lower portion of the sheet cassette 10*a* in the paper feed direction (the leftward direction of FIG. 3), winding pulleys 40*a* and 40*b* are arranged. The winding pulleys 40*a* and 40*b* are coupled to a shaft 41 and can be rotated along with the shaft 41. Two wires 43*a* and 43*b* are wound around the winding pulleys 40*a* and 40*b*, respectively. The wire 43*a* is coupled to a paper feed direction downstream side end portion of the lift plate 30 through a fixed pulley 45*a*; the wire 43*b* is coupled to a paper feed direction upstream side end portion of the lift plate 30 through a fixed pulley 45*b*.

When the sheet cassette 10*a* is fitted into the image forming apparatus 100, a drive input coupling (unillustrated) on the body side of the image forming apparatus 100 is coupled to the winding pulley 40*a*. Then, in order for the paper feed from the sheet cassette 10*a* to be smoothly and reliably performed, the winding pulleys 40*a* and 40*b* are rotated in the direction in which the wires 43*a* and 43*b* are wound (the clockwise direction in FIG. 3) according to the decrease in the number of sheets left, and thus the lift plate 30 is gradually moved up. In this way, a positional relationship between the uppermost position of the sheets and the paper feed mechanism 23*a* (see FIG. 1) is maintained.

On the side of the winding pulley 40*a*, an idle gear 47 having a larger diameter than that of the winding pulley 40*a* is arranged. The idle gear 47 is attached to the side surface of the sheet storage portion 31 by a gear attachment cover 48, and engages with a gear portion 40*a* b (see FIG. 5) of the winding pulley 40*a*.

Figure 4:
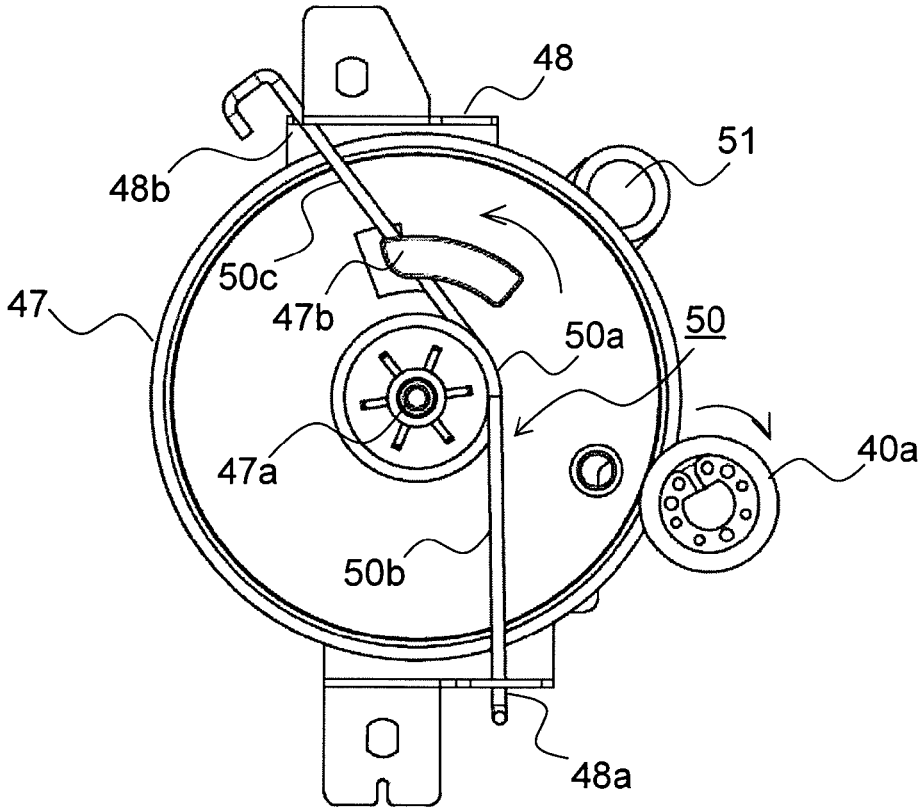
FIG. 4 is a plan view when the configuration of the sheet cassette 10*a* in the vicinity of a winding pulley 40*a* and an idle gear 47 is seen from the back of FIG. 3.
Figure 5:
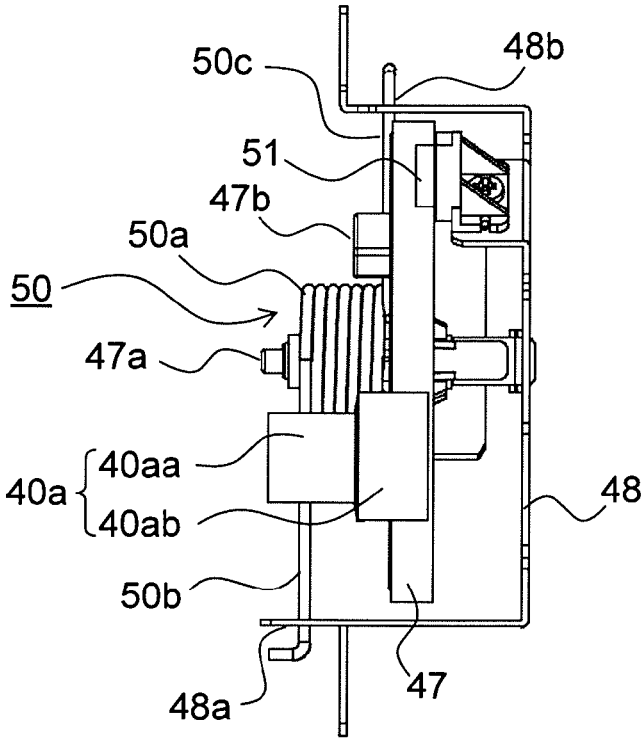
FIG. 5 is a side view when the configuration of the sheet cassette 10*a* in the vicinity of the winding pulley 40*a* and the idle gear 47 is seen from a rightward direction of FIG. 4.

FIG. 4 is a plan view when the configuration of the sheet cassette 10*a* in the vicinity of the winding pulley 40*a* and the idle gear 47 is seen from the back of FIG. 3; FIG. 5 is a side view when the configuration of the sheet cassette 10*a* in the vicinity of the winding pulley 40*a* and the idle gear 47 is seen from a rightward direction of FIG. 4. FIGS. 4 and 5 show a state where no sheet is placed on the lift plate 30. In the winding pulley 40*a*, a winding portion 40*a* a for winding the wires 43*a* and 43*b* and the gear portion 40*a* b where a spur gear engaging with the idle gear 47 is formed are integrally formed.

A torsion spring 50 is fitted on the side of the back surface of the idle gear 47. The torsion spring 50 is composed of a winding spring portion 50*a* that has the rotation shaft 47*a* of the idle gear 47 inserted therethrough and a first arm portion 50*b* and a second arm portion 50*c* that extend in different directions from the winding spring portion 50*a*. The first arm portion 50*b* is inserted through a fixed hole 48*a* formed in a lower portion of the gear attachment cover 48 and is fixed. The second arm portion 50*c* engages with an engagement portion 47*b* formed on the side surface of the idle gear 47; the end vicinity portion of the second arm portion 50*c* is pressed, by a force exerted by the torsion spring 50, onto a holding portion 48*b* formed in an upper portion of the gear attachment cover 48. The idle gear 47, the gear attachment cover 48 and the torsion spring 50 constitute a standby mechanism for placing the lift plate 30 on standby in a predetermined position.

A dumper gear 51 is coupled to an upper portion of the idle gear 47. The dumper gear 51 incorporates a torque limiter and provides a load to the rotation of the idle gear 47, and thereby maintains the downward speed of the lift plate 30. In this way, when the sheet cassette 10*a* is pulled out of the body of the image forming apparatus 100, it is possible to prevent the lift plate 30 from rapidly dropping by its weight, to prevent noise from being produced and to enhance safety.

A procedure of setting sheets into the sheet storage portion 31 of the sheet cassette 10*a* will now be described. When all the sheets within the sheet storage portion 31 are fed, and no sheets are present on the lift plate 30, the sheet cassette 10*a* is pulled out of the body of the image forming apparatus 100. The drive input coupling on the body side of the image forming apparatus 100 that has engaged with the winding pulley 40*a* is disengaged, and the winding pulleys 40*a* and 40*b* are rotated by the weight of the lift plate 30 in the direction in which the wires 43*a* and 43*b* are drawn out (the clockwise direction in FIG. 4).

By the rotation of the winding pulley 40*a*, the idle gear 47 engaging with the gear portion 40*a* b of the winding pulley 40*a* is also rotated in the counterclockwise direction of FIG. 4. Since the load exerted by the dumper gear 51 is applied to the idle gear 47, the rotational speed of the idle gear 47 and the winding pulley 40*a* is regulated, and the lift plate 30 is moved down slowly.

Then, when the idle gear 47 is rotated by a predetermined amount, the idle gear 47 is brought into the state of FIG. 4 where the engagement portion 47*b* of the idle gear 47 engages with the second arm portion 50*c* of the torsion spring 50. Here, since the force exerted by the torsion spring 50 is set greater than the force that rotates the idle gear 47*b* y the downward movement of the lift plate 30, the rotation of the idle gear 47 and the winding pulley 40*a* is regulated, and thus the lift plate 30 is always stopped in a substantially constant position. Specifically, the winding pulley 40*a* and the idle gear 47 are brought into phase with each other such that the upper surface of the lift plate 30 is stopped at the lower end portion 49 (see FIG. 2) of the sheet supply opening portions 31*a* and 31*b* formed in the side walls of the sheet storage portion 31.

In this way, when no sheets are present and then the sheet cassette 10*a* is pulled out of the body of the image forming apparatus 100, the lift plate 30 is stopped such that, constantly, the lift plate 30 is substantially flush with the lower end portion of the sheet supply opening portions 31*a* and 31*b*. Hence, when the hands are inserted through the sheet supply opening portions 31*a* and 31*b* to set the sheets from the upper portion of the sheet storage portion 31, it is not necessary to put the hands below the lower end portion 49 of the sheet supply opening portions 31*a* and 31*b*, and thus it is possible to smoothly and reliably set the sheets on the lift plate 30 without the hands being caught between the sheet supply opening portions and the sheets and to prevent a paper feed failure resulting from a sheet set failure. Since the drawing out of the wire 43*a* from the winding pulley 40*a* is performed in synchronization with the lowering of the tray 30, the wire 43*a* is prevented from loosening.

Figure 6:
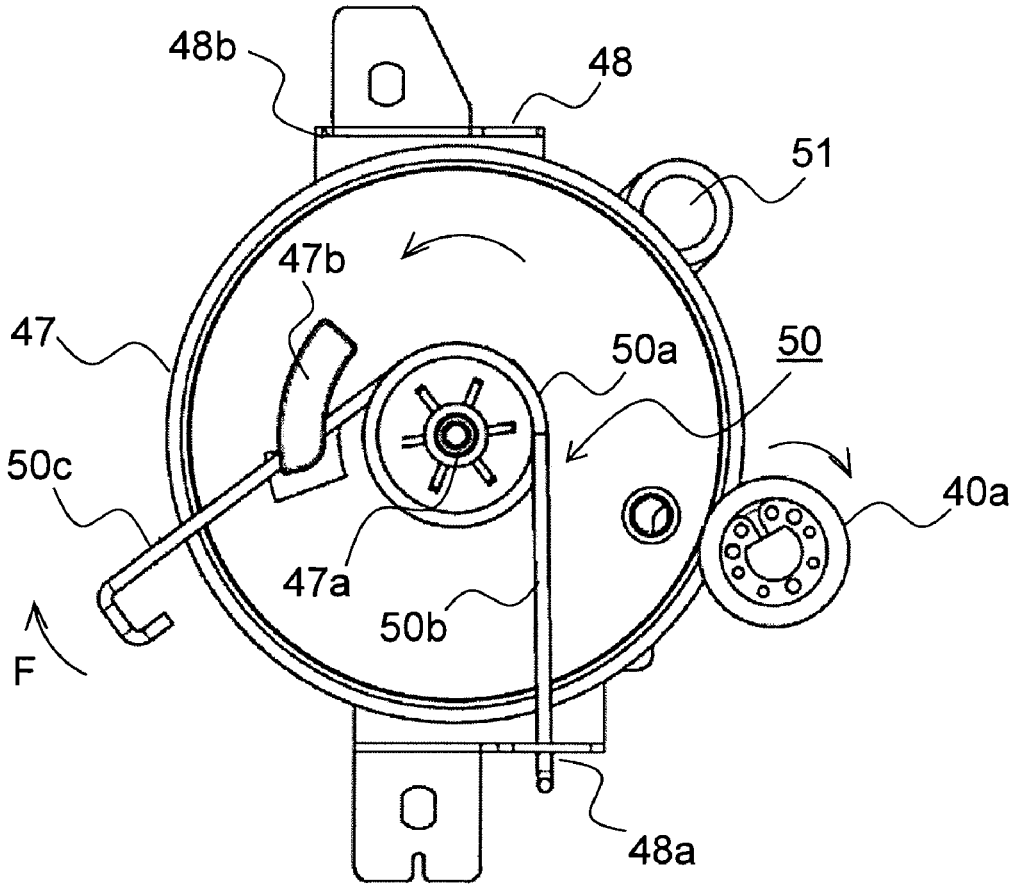
FIG. 6 is a plan view when, with the full number of sheets placed on a lift plate 30 of the sheet cassette 10*a*, the configuration of the sheet cassette 10*a* in the vicinity of the winding pulley 40*a* and the idle gear 47 is seen from the back of FIG. 3.

Since, when sheets are set on the lift plate 30, the lift plate 30 is lowered by the weight of the sheets, the winding pulley 40*a* is further rotated in the clockwise direction of FIG. 4, and the idle gear 47 is also further rotated in the counterclockwise direction of FIG. 4. Consequently, the second arm portion 50*c* of the torsion spring 50 is pressed by the engagement portion 47*b* to separate from the holding portion 48*b*, and is rotated in a direction in which the second arm portion 50*c* is moved close to the first arm portion 50*b* (the counterclockwise direction of FIG. 4). Then, with the full number of sheets placed on the lift plate 30, as shown in FIG. 6, the second arm portion 50*c* is rotated approximately 90 degrees from the position of FIG. 4.

In other words, since, as the number of sheets stacked on the lift plate 30 is increased, the amount of rotation of the second arm portion 50*c* is increased, the force F exerted by the torsion spring 50 is increased in proportion to the number of sheets stacked on the lift plate 30. Hence, by adjusting the spring constant of the torsion spring 50, it is possible to perform setting such that, constantly, the uppermost surface of the sheets stacked on the lift plate 30 is substantially flush with the lower end portion 49 of the sheet supply opening portions 31*a* and 31*b*. When, in this configuration, sheets are set by performing a plurality of rounds of the setting or even when sheets are added with some sheets left in the sheet storage portion 31, it is not necessary to put the hands below the lower end portion 49 of the sheet supply opening portions 31*a* and 31*b*. It is therefore possible to smoothly and reliably set sheets on the already stacked sheets without the hands being caught between the sheet supply opening portions and the sheets.

The present disclosure is not limited to the embodiment described above, and many modifications are possible without departing from the spirit of the present disclosure. For example, in the present disclosure, the upper surface of the lift plate 30 without sheets or the uppermost surface of sheets with a predetermined number of sheets set is substantially flush with the lower end portion 49 of the sheet supply opening portions 31*a* and 31*b*. Instead of the above configuration, the upper surface of the lift plate 30 or the uppermost surface of the sheets may be arranged above the lower end portion 49 of the sheet supply opening portions 31*a* and 31*b*. Even in this case, since it is not necessary to put the hands below the lower end portion 49, it is possible to prevent the hands from being caught between the sheet supply opening portions 31*a* and 31*b* and the sheets.

The gear diameter and the gear ratio of the gear portion 40*a* b of the winding pulley 40*a* and the idle gear 47 can be appropriately set according to the thickness and the maximum winding amount of the wires 43*a* and 43*b* used, the distance of upward and downward movement of the lift plate 30 and the like. Furthermore, the present disclosure is absolutely equally applicable not only to the sheet cassettes 10*a* and 10*b* previously fitted to the body of the image forming apparatus 100 described above but also to a paper feed unit that can be optionally retrofitted to the image forming apparatus 100.

The present disclosure can be utilized in a large-capacity sheet storage device that moves up and down a lift plate with wires. According to the present disclosure, when sheets are set, the upper surface of the lift plate or the uppermost surface of sheets can be constantly maintained in a position equal to or higher than the lower end portion of the sheet supply opening portion, and a sheet storage device that enhances the performance of setting sheets can be simply provided at a low cost.

What is claimed is:

1. A sheet storage device comprising:

a sheet storage portion that stores a sheet;

a sheet supply opening portion that is formed from an upper end of a side wall of the sheet storage portion in a vertically downward direction;

a lift plate that is arranged in the sheet storage portion such that the lift plate can be moved up and down;

a wire with which the lift plate is hung;

a winding pulley that moves the lift plate up to a predetermined position by winding the wire;

an idle gear that engages with a gear portion formed in the winding pulley; and a torsion spring that includes a winding spring portion which is fitted to a rotation shaft of the idle gear and a first arm portion and a second arm portion which extend from the winding spring portion and that has the first arm portion fixed to a side of the sheet storage portion, wherein, with the sheet storage device removed from a body of an image forming apparatus, the winding pulley is reversely rotated by a weight of the lift plate, the lift plate is lowered and the second arm portion engages with an engagement portion provided on a side surface of the idle gear such that an upper surface of the lift plate on which no sheet is stacked is stopped in a substantially constant position equal to or higher than a lower end portion of the sheet supply opening portion.

2. The sheet storage device of claim 1, wherein a spring constant of the torsion spring is adjusted such that, when a sheet is stacked on the lift plate, regardless of a number of sheets stacked, an uppermost surface of the sheets is constantly stopped in the position equal to or higher than the lower end portion of the sheet supply opening portion.

3. The sheet storage device of claim 1, wherein a force exerted by the torsion spring is set greater than a force that rotates the idle gear by lowering of the lift plate by a weight of the lift plate.

4. The sheet storage device of claim 3, wherein, when no sheet is stacked on the lift plate, the second arm portion is pressed onto a side of the sheet storage portion a predetermined angle away from a position where the first arm portion is fixed with a rotational shaft of the idle gear being a center.

5. The sheet storage device of claim 1, wherein a dumper gear incorporating a torque limiter is coupled to the idle gear.

6. An image forming apparatus comprising:

the sheet storage device of claim 1; and an image formation portion that forms an image on a sheet.

* * * * *